United States Patent [19]

Mattei et al.

[11] Patent Number: 4,945,926

[45] Date of Patent: Aug. 7, 1990

[54] DEVICE FOR FEEDING STRIP PAPER ON A DUAL-ROD CIGARETTE MANUFACTURING MACHINE

[75] Inventors: Riccardo Mattei, Bologna; Bruno Belvederi, S. Martino Di Monte S. Pietro, both of Italy

[73] Assignee: G. D Societa' Per Azioni, Bologna, Italy

[21] Appl. No.: 2,294

[22] Filed: Jan. 12, 1987

[30] Foreign Application Priority Data

Jan. 20, 1986 [IT] Italy ..... 3308 A/86

[51] Int. Cl.[5] ..... A24C 5/18

[52] U.S. Cl. :..... 131/84.1

[58] Field of Search ..... 131/84.1; 493/39

[56] References Cited

U.S. PATENT DOCUMENTS 4,583,557 4/1986 Mattei et al. ..... 131/84.1

*Primary Examiner*—V. Millin

*Attorney, Agent, or Firm*—Marshall, O'Toole, Gerstein, Murray & Bicknell

[57] ABSTRACT

On a dual-rod cigarette manufacturing machine, the two paper strips for wrapping the two rods are obtained by longitudinally dividing a main strip by means of a cutting device, the strips being fed to the wrapping section along the same route, along which there is provided, for each strip, a tension detecting device. Should the tension of the two strips depart from a preset value, when the tension of at least one of the strips departs from a given tension range, the respective detecting device provides for regulating the speed of the main strip so as to restore correct tension on both strips.

3 Claims, 3 Drawing Sheets

DEVICE FOR FEEDING STRIP PAPER ON A DUAL-ROD CIGARETTE MANUFACTURING MACHINE

BACKGROUND OF THE INVENTION

The present invention relates to a device for feeding strip paper on a dual-rod cigarette manufacturing machine. On dual-rod cigarette manufacturing machines, cigarettes are usually formed by feeding two strips of paper through a filling station where a continuous layer of shredded tobacco is fed onto each strip.

Each strip of paper and the respective layer of tobacco are then fed through a forming fixture along which the opposite side edges of the strip are gradually folded together about the layer of tobacco and then stuck together to form a continuous cigarette rod which is cut into single cigarette lengths, together with the other rod, by a single cutting head turning at constant speed.

The paper strips are usually fed through the machine by means of a feed device comprising a reel-off unit for reeling off a coil a strip of paper twice the width of the said strips. The speed at which the said single strip is reeled off the coil is timed to the cutting rate of the said cutting head, in such a manner as to produce, at least theoretically, cigarettes of a given length. The said feed device also comprises a cutting unit for cutting the said single strip longitudinally into the said two strips, each of which is fed onto a respective conveyor extending along the said forming fixture and responsible for feeding the respective strip along the same. Mating of each strip on the respective conveyor only occurs in the presence of the respective layer of tobacco, which, when arranged over the paper strip, determines mechanical mating by friction between the conveyor and the respective strip.

On dual-rod cigarette manufacturing machines of the aforementioned type, after a given operating time, and particularly on account of differing wear, i.e. differing thickness, of the two conveyor belts, the two paper strips have been found to travel at different speeds and, owing to the common source of both strips, are subjected to different tensions which may lead to tearing of at least one of them.

For this reason, Italian Patent Application No. 3440A/83 filed by the present Applicant provides for means for controlling the tension of both paper strips, each of which means regulates the speed of the respective conveyor and, consequently, the speed and tension of the respective paper strip.

In actual practice, however, providing the conveyors are replaced periodically and both strips are fed along exactly the same route, the tension of both strips has been found to depart by a very limited amount and in the same direction from a given preset value.

Consequently, under normal operating conditions, the respective tensions of both strips tend to remain substantially the same, even while departing from the said given preset value.

In the light of this discovery, known devices have proved complex, expensive and, more importantly, poorly suited for meeting the requirements of such machines, at least when operated under normal conditions.

SUMMARY OF THE INVENTION

The aim of the present invention is to provide a device designed to overcome the aforementioned drawbacks typical of known devices.

With this aim in view, according to the present invention, there is provided a device for feeding strip paper on a dual-rod cigarette manufacturing machine, said device comprising means for supplying a main strip; a cutting device for longitudinally dividing the said main strip into two strips for wrapping two continuous cigarette rods; transmission means for feeding the said strips along the same route; and a tension detecting device connected to each of the said two strips; characterised by the fact that it comprises means, connected to the said tension detecting devices, for regulating the speed of the said means supplying the said main strip.

BRIEF DESCRIPTION OF THE DRAWINGS

One embodiment of the present invention will be described, by way of a non-limiting example, with reference to the accompanying drawings, in which.

DETAILED DESCRIPTION OF THE INVENTION

Figure 1:
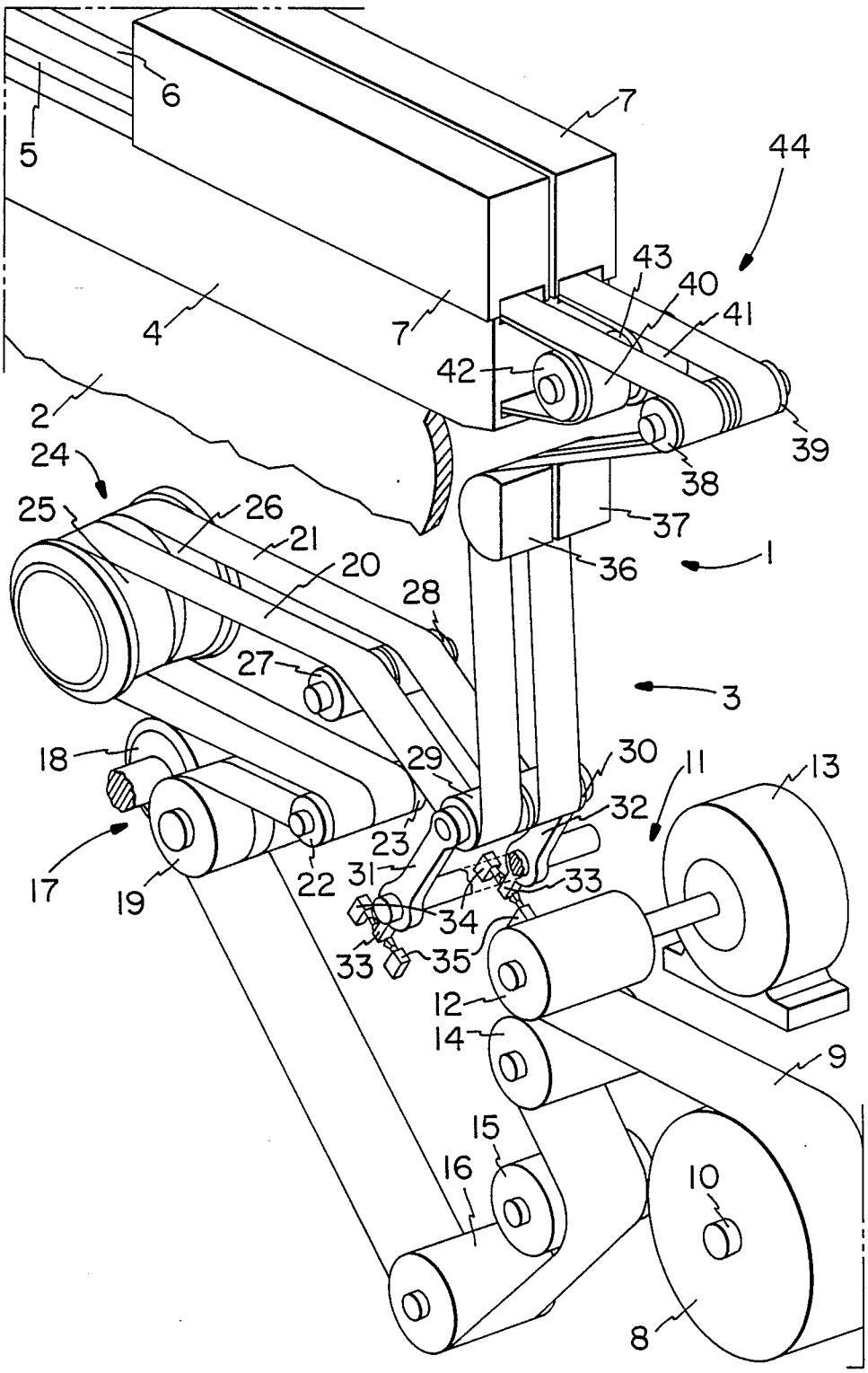
FIG. 1 shows a view in perspective of the device according to the teachings of the present invention.

Number 1 in FIG. 1 indicates a dual-rod cigarette manufacturing machine comprising a frame 2 supporting a paper feed device 3 and a top bed 4 for forming two continuous cigarette rods 5 and 6.

Rods 5 and 6 are formed inside respective forming fixtures 7, arranged side by side on bed 4, and are fed to a cutting station (not shown) where they are cut simultaneously into cigarettes of a given length by a single, known rotary cutting head (not shown).

Paper feed device 3 comprises a coil 8 for supplying a paper strip 9 hereinafter also referred to as the main strip.

Coil 8 is mounted in rotary manner on a substantially horizontal shaft 10 supported on frame 2, and is unwound by supply means consisting of a reel-off unit 11 comprising a roller 12, mounted on the output shaft of motor 13, and a pressure roller 14; said rollers 12 and 14 having their axes parallel with that of coil 8 and being supported on frame 2.

Via two transmission rollers 15 and 16, strip 9 from rollers 12 and 14 is fed to a cutting device 17 comprising a disc cutter 18 and a counter-roller 19, both supported on frame 2 and turning about axes parallel with that of coil 8. The said cutting device 17 is designed to cut strip 9 longitudinally into two strips 20 and 21 of the same width.

Figure 2:
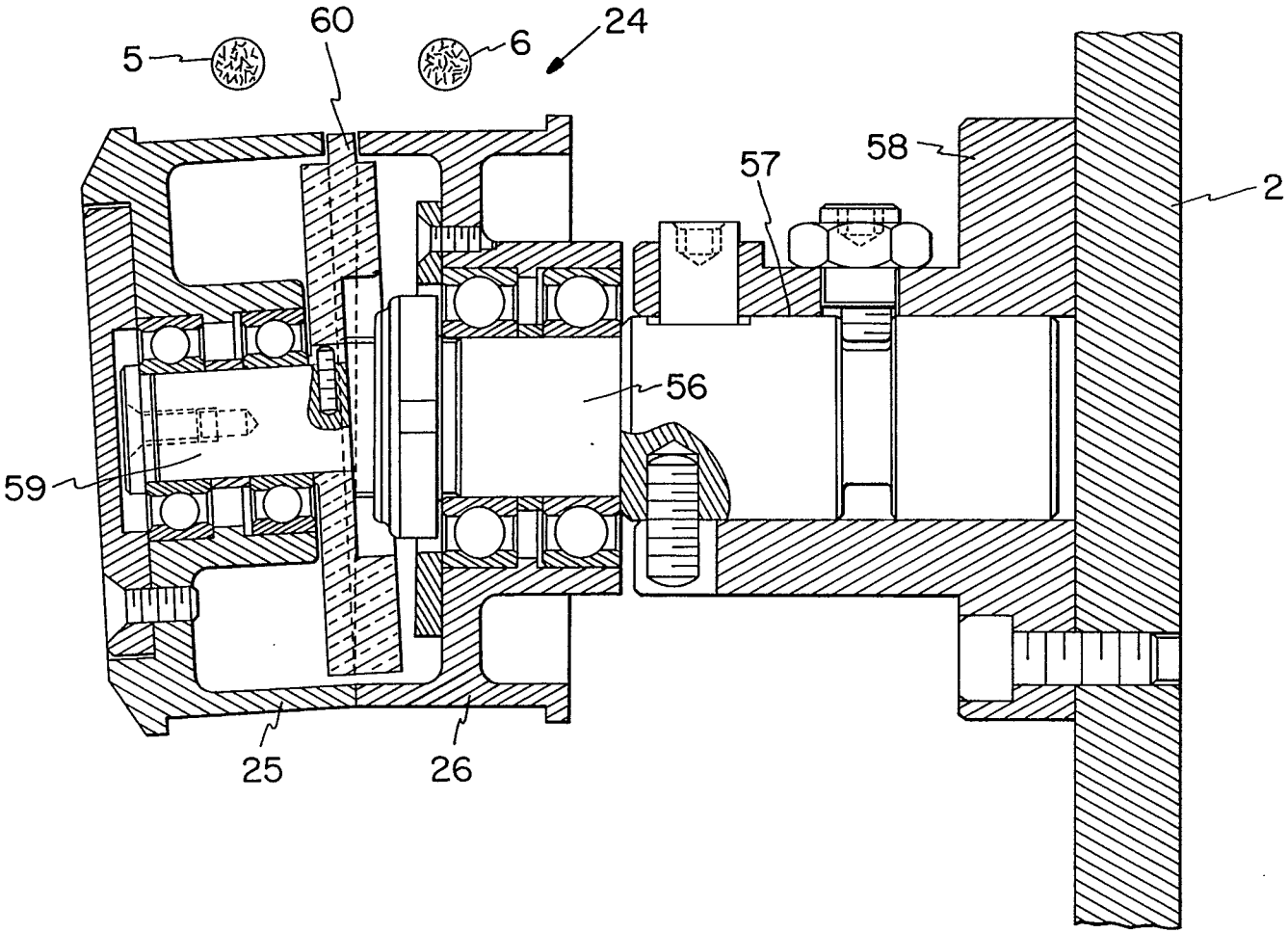
FIG. 2 shows a larger-scale view of a detail in FIG. 1.

The said two strips 20 and 21 from cutting device 17 are detoured by respective coaxial transmission rollers 22 and 23 towards a parting device 24 shown in more detail in FIG. 2.

The said device 24 comprises two rollers 25 and 26 mounted on a slant so as to part the said two strips 20 and 21 crosswise in relation to their respective longitudinal axes.

The said two strips 20 and 21, detoured by respective coaxial transmission rollers 27 and 28, are wound about respective rollers 29 and 30. The said rollers 29 and 30, which form part of safety devices described in more detail later on, are mounted in rotary manner on the arms of respective levers 31 and 32 pivoting on a single shaft supported on frame 2 parallel with the axis of coil 8.

The arm of each lever 31 and 32 presents an appendix 33 between two limit switch contacts 34 and 35, each designed to emit machine-stop signals when contacted by one of appendixes 33.

Upon leaving rollers 29 and 30, strips 20 and 21 are fed to respective tension detectors 36 and 37.

Each of the said tension detectors 36 and 37 consists of a transducer comprising a load cell designed, in known manner, to emit, over its output circuit (FIG. 3), a signal proportional to the tension of the respective paper strip. From tension detectors 36 and 37, strips 20 and 21 are fed to respective rollers 38 and 39 which feed them onto the top branches of respective conveyors 40 and 41 having respective drive rollers 42 and 43 and extending over bed 4 through forming fixtures 7. Prior to reaching forming fixtures 7, conveyors 40 and 41 feed strips 20 and 21 through a filling station 44 where a tobacco feed device (not shown) feeds respective continuous layers of shredded tobacco onto strips 20 and 21.

Inside forming fixtures 7, the opposite side edges of each of strips 20 and 21 are folded together in known manner and stuck together so as to enclose the respective continuous layer of tobacco and so form continuous rods 5 and 6.

Figure 3:
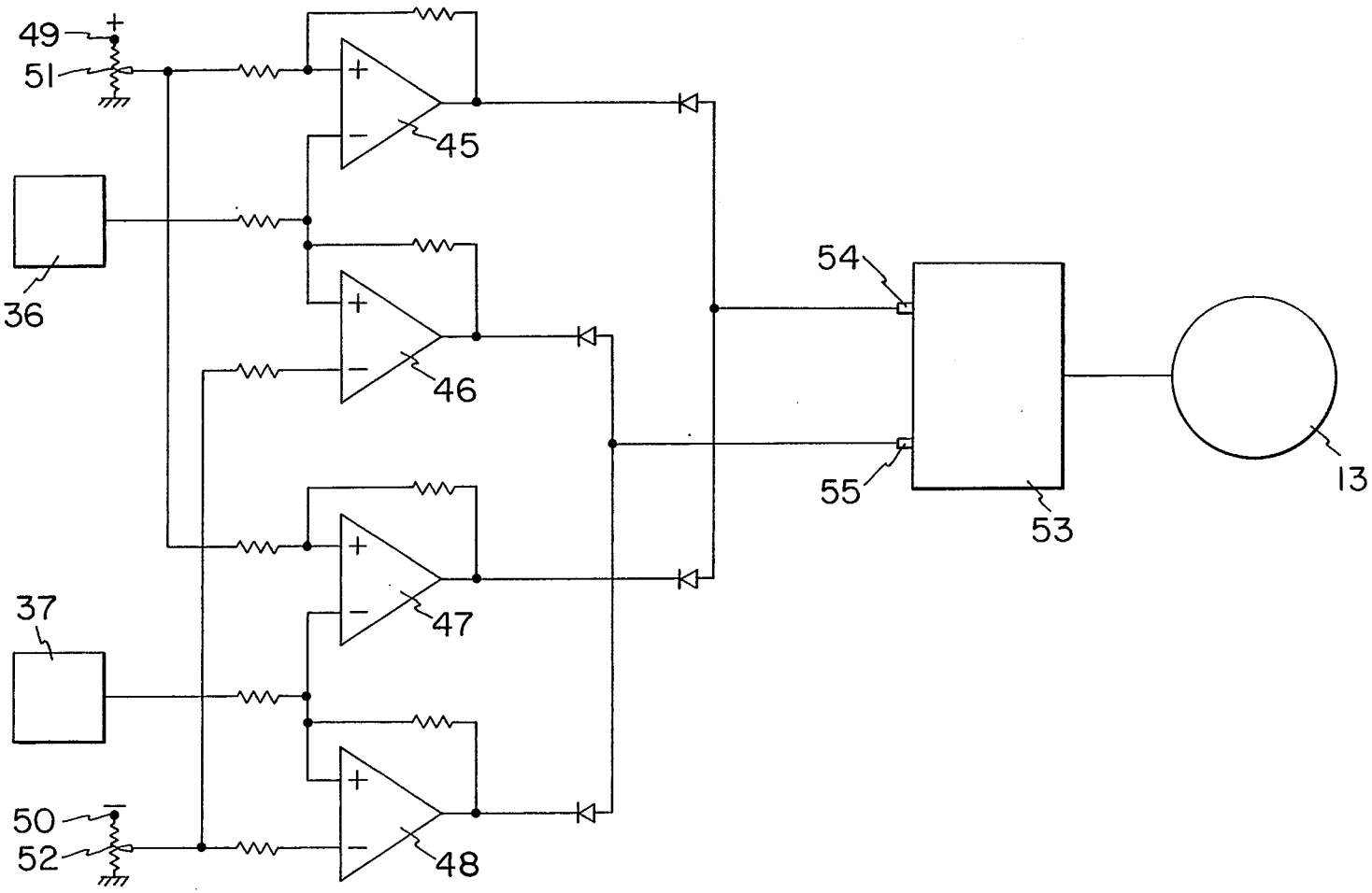
FIG. 3 shows a block diagram of the electrical control on the device according to the present invention.

With reference to the block diagram in FIG. 3, the output of tension detector 36 is connected to the first inputs of two comparators 45 and 46, and the output of tension detector 37 to the first inputs of two comparators 47 and 48.

Terminals 49 and 50 present two given voltages adjustable by means of respective rheostats 51 and 52 and constituting reference or threshold values for the said comparators.

In more detail, the positive inputs of comparators 45 and 47 are connected to terminal 49 presenting the upper reference or threshold voltage, whereas the negative inputs of comparators 46 and 48 are connected to terminal 50 presenting the lower reference or threshold voltage. Together with a known circuit 53 activating motor 13, comparators 45, 46, 47 and 48 constitute means for regulating the speed of unit 11 reeling off main strip 9. The said activating circuit 53 presents a first input 54, to which are connected the outputs of comparators 45 and 47, and a second input 55 to which are connected the outputs of comparators 46 and 48.

In actual use, and under correct, normal operating conditions, reel-off unit 11 supplies, within a given time interval, a length of main strip 9 exactly equal to the lengths of strips 20 and 21 traveling, within the same time interval, through forming fixtures 7, and the tensions of strips 20 and 21, as detected by transducers 36 and 37, are substantially equal and within a given preset range.

At the input of respective comparators 45, 46 and 47, 48, the tensions of strips 20 and 21 are converted into voltage signals falling within the range defined by the two threshold values at terminals 49 and 50.

Consequently, at the output of comparators 45, 46, 47 and 48, no signals are directed towards the two inputs of activating circuit 53, and main strip 9 is fed at a given constant speed.

Supposing, however, that, in time, due to gradual wear of conveyors 40 and 41 and changes in the quality of the tobacco fed onto the strips in filling station 44, the tension of strips 20 and 21 increases towards the said upper limit value.

As soon as the tension of at least one of the strips, e.g. strip 20, exceeds the said value, the voltage signal at the output of detector 36 exceeds the signal at terminal 49.

A signal is therefore sent from comparator 45 to input 54 of activating 53, which provides for accelerating motor 13.

Subsequent to increasing the speed of main strip 9, the tension of strips 20 and 21 slackens off gradually to return within the range defined by the said two limit values, thus cancelling the output signal from comparator 45.

The same, obviously, applies in the event the tension of strips 20 and 21 slackens off towards the said lower limit value.

In this case, as soon as the tension of at least one of the strips, e.g. strip 21, exceeds the said value, comparator 48 supplies a signal to input 55 of activating circuit 53, which provides for decelerating motor 13.

Deceleration of motor 13 results in a gradual increase in the tension of strips 20 and 21, and cancellation of the output signal from comparator 48, as soon as the tension of strips 20 and 21 falls back within the range defined by the said limit values.

Should the tension of one or both of strips 20 and 21 vary drastically in relation to the normal operation conditions referred to in the foregoing description, this activates the safety devices of which form part rollers 29 and 30 and levers 31 and 32.

The said levers 31 and 32, turning about their respective axes, shut down machine 1 upon appendixes 33 contacting contacts 34 or 35.

As shown in FIG. 2, parting device 24 provides for transversely spacing strips 20 and 21 as required for forming two continuous cigarette rods, while at the same time meeting the aforementioned condition of feeding strips 20 and 21 along the same route.

Roller 26 realtive to strip 21 is mounted on a first portion 56 of a pin 57 supported on frame 2 by means of flange 58, whereas roller 25 relative to strip 20 is mounted on a second portion 59 of pin 57 tilted at a given angle in relation to portion 56.

The opening formed between rollers 25 and 26, as a result of non-coaxial mounting of the same, is closed off by a disc 60 mounted on pin 59.

We claim:

1. A device for feeding strip paper on a dual-rod cigarette manufacturing machine (1), said device comprising means (11) for supplying a main strip (9); a cutting device (17) for longitudinally dividing the said main strip (9) into two strips (20, 21) for wrapping two continuous cigarette rods; transmission means (20–30; 38, 39) for feeding the said strips along the same route; and a tension detecting device (36, 37) connected to each of the said two strips (20, 21); characterised by the fact that it comprises means (45, 46, 47, 48, 53), connected to the said tension detecting devices (36, 37), for regulating the speed of the said means (11) supplying the said main strip (9).

2. A device as claimed in claim 1, characterised by the fact that the said tension detecting devices consist of transducers (36, 37) emitting signals indicating the tension of the said strips (20, 21); the said speed regulating means comprising comparator circuits (45, 46, 47, 48)

for comparing the output signals from the said transducers (36, 37) with two given fixed signals indicating limit tension values of the said strips (20, 21), and an activating circuit (53) connected to the outputs of the said comparator circuits (45, 46, 47, 48) and controlling the said supply means (11).

3. A device as claimed in claim 1, characterised by the fact that the said transmission means comprise means (24) for parting the said strips (20, 21) transversely in relation to their longitudinal axes, and consisting of a pair of rollers (25, 26) mounted side by side and in idle manner on two portions (59, 56) of a pin (57), the axes of the said two portions (59, 56) defining a given angle.

* * * * *